US005799801A

United States Patent [19]

Clark et al.

[11] Patent Number: 5,799,801

[45] Date of Patent: Sep. 1, 1998

[54] METHOD AND APPARATUS FOR SEPARATING PAPER FROM CARDBOARD

[75] Inventors: Brian K. Clark; Roy R. Miller, both of Eugene, Oreg.

[73] Assignee: Bulk Handling System, Inc., Eugene, Oreg.

[21] Appl. No.: 430,728

[22] Filed: Apr. 27, 1995

Related U.S. Application Data

[63] Continuation-in-part of Ser. No. 263,524, Jun. 22, 1994, Pat. No. 5,450,966.

[51] Int. Cl.[6] ..... B07B 13/05

[52] U.S. Cl. ..... 209/667; 209/261; 209/672

[58] Field of Search ..... 209/659, 660, 209/666, 667, 668, 671, 672, 261

[56] References Cited

U.S. PATENT DOCUMENTS

| | | | |
|---|---|---|---|
| 513,089 | 1/1894 | Crockett | 209/672 X |
| 530,262 | 12/1894 | Distl et al. | 209/667 |
| 785,508 | 3/1905 | Mason | 209/672 X |
| 1,941,147 | 12/1933 | Johlige | 209/672 X |
| 2,124,856 | 7/1938 | Kohler | 209/672 |
| 2,370,539 | 2/1945 | Hodecker | 209/668 |
| 2,417,921 | 3/1947 | Fox | 209/667 |
| 2,588,309 | 3/1952 | Troyer | 209/667 |
| 2,743,813 | 5/1956 | Erickson | 209/672 X |
| 3,367,494 | 2/1968 | Peterson | 209/668 |
| 3,870,627 | 3/1975 | Herkes | 209/236 X |
| 4,301,903 | 11/1981 | Smith | 209/671 |
| 4,539,734 | 9/1985 | Gill | 209/668 |
| 4,653,648 | 3/1987 | Bielagus | 209/672 |
| 4,795,036 | 1/1989 | Williams | 209/667 |
| 4,836,388 | 6/1989 | Bielagus | 209/672 |
| 4,858,180 | 8/1989 | Eriksson | 209/664 |
| 4,901,864 | 2/1990 | Dougherty | 209/672 |
| 5,051,172 | 9/1991 | Gilmore | 209/672 |
| 5,060,806 | 10/1991 | Savage | 209/668 |
| 5,163,564 | 11/1992 | Matula | 209/667 X |
| 5,232,097 | 8/1993 | Tohkala | 209/234 |
| 5,361,909 | 11/1994 | Gemmer | 209/12.1 |
| 5,480,034 | 1/1996 | Kobayashi | 209/672 X |

FOREIGN PATENT DOCUMENTS

| | | | |
|---|---|---|---|
| 618154 | of 0000 | Germany | 209/672 |
| 592126 | 1/1934 | Germany | 209/672 |
| 609919 | 2/1935 | Germany | 209/672 |
| 3926451 | 3/1991 | Germany | 209/672 |

OTHER PUBLICATIONS

Bulk Handing Systems Product Brochure, *BHS Disc--Screens*, two pages.

*Primary Examiner*—Joseph E. Valenza
*Assistant Examiner*—Tuan N. Nguyen
*Attorney, Agent, or Firm*—Marger, Johnson, et al.

[57] ABSTRACT

A disc screen classifies material by size. The disc screen includes a frame, a plurality of shafts mounted on the frame parallel with one another and a first stage including discs mounted on the shafts in a substantially coplanar row. Each of the discs has a perimeter shaped to maintain the space between discs substantially constant during rotation. A second stage includes discs mounted on the shafts in a substantially coplanar row. Each of the discs has a perimeter shaped to maintain the space between discs substantially constant during rotation. A receiving section agitates debris while the debris moves at an angle up to a given elevation. A roll over section drops the materials down to a discharge position for feeding onto a discharge section. The materials are dropped from the roll over so that the debris either falls vertically or flips over further promoting separation. The discharge section again agitates the debris while moves up a second incline until the larger debris discharges out a rear end.

15 Claims, 8 Drawing Sheets

METHOD AND APPARATUS FOR SEPARATING PAPER FROM CARDBOARD

This invention is a continuation in part of patent application Ser. No. 08/263,524 now issued U.S. Pat. No. 5,450,966 entitled Method and Apparatus for Classifying Materials filed on Jun. 22, 1994 which was previously disclosed in the United States Patent and Trademark Office as evidenced by Disclosure Document No. 326,571, date stamped Mar. 5, 1993. Disclosure Document No. 326,571 is hereby incorporated by reference herein for all purposes and made a part of this application.

BACKGROUND OF THE INVENTION

1. Field of the Invention

This invention relates to an apparatus for separating various office paper products by material and by size. In particular, this invention relates to improvements in a conveyer with a unique disc screen that improves the screen's performance and reduces maintenance thereof.

2. Description of the Related Art

Disc or roll screens, as contemplated by the present invention are frequently used as part of a multi-stage materials separating system. Disc screens are used in the materials handling industry for screening large flows of materials to remove certain items of desired dimensions. In particular, disc screens are particularly suitable for classifying what is normally considered debris or residual materials. This debris may consist of various constituents. It may contain soil, aggregate, asphalt, concrete, wood, biomass, ferrous and nonferrous metal, plastic, ceramic, paper, cardboard, or other products or materials recognized as debris throughout consumer, commercial and industrial markets. The function of the disc screen is to separate the materials fed into it by size. The size classification may be adjusted to meet virtually any specific application.

Disc screens generally have a screening bed having a series of rotating spaced parallel shafts each of which has a longitudinal series of concentric screen discs separated by spacers which interdigitate with the screen discs of the adjacent shafts. The relationship of the discs and spacers on one shaft to the discs and spacers on each adjacent shaft form an opening generally known in the industry as the interfacial opening or "IFO". The IFOs permit only material of acceptable size to pass downwardly through the rotating disc bed. The acceptable sized material which drops through the IFO is commonly referred to in the industry as Accepts or Unders.

The discs are all driven to rotate in a common direction from the infeed end of the screen bed to the outfeed or discharge end of the bed. Thus, materials which are larger than the IFO, referred to in the industry as Overs, will be advanced on the bed to the outfeed end of the bed and rejected.

A major problem with such disc screens is jamming. Where the discs are not in line, material tends to jam between the disc and the adjacent shaft, and physically forcing the screen to stop. This phenomenon can be deleterious to the conventional disc screen. Although the jamming phenomenon may not cause the roll screen to stop completely, it may cause momentary stoppages. Such stoppages may not cause the drive mechanism of the roll screen to turn off but they may cause substantial mechanical shock. This mechanical shock will eventually result in the premature failure of the roll screen's roll assemblies and drive mechanism.

Another problem with disc screens is effectively separating debris having similar shapes. For example, it is difficult to separate office sized waste paper (OWP) since much of the OWP has the same long thin shape. For example, it is difficult to effectively notebook paper from old corrugated cardboard (OCC) since each is long and relatively flat.

Accordingly, an important object of the present invention is to provide a new and useful apparatus for classifying material by size which avoids the problem of jamming.

Another object of the invention is to provide a new and useful method of classifying material by size which avoids the problem of jamming.

Another object of the invention is to increase efficiency in separating different office size waste paper.

SUMMARY OF THE INVENTION

The invention concerns an apparatus for classifying material by size. It comprises a frame, a plurality of shafts mounted on the frame substantially parallel with one another and defining a substantially planar array, means for rotating the shafts in ganged relation to one another, and a plurality of discs mounted on the shafts in a substantially coplanar row, each of the discs having a perimeter shaped to maintain the space between discs substantially constant during rotation.

In accordance with this invention, we disclose a method for classifying material by size. This method comprises defining a plurality of substantially uniform openings disposed between a plurality of shafts arranged to define a substantially planar array, mounting noncircular discs on the shafts in substantially parallel rows, rotating the shafts in the same direction, dropping the material on the shafts at one side of the array so that shaft rotation causes the material to be pushed by the discs across the remainder of the shafts in the array, and maintaining the spacing between discs in a row substantially uniform during rotation.

In an alternative embodiment of the invention, we disclose an apparatus for classifying material by size which includes a frame; a plurality of shafts mounted on the frame substantially parallel with one another; a first stage including discs mounted on the shafts in a substantially coplanar row, each of the discs having a perimeter shaped to maintain the space between discs substantially constant during rotation; and a second stage including discs mounted on the shafts in a substantially coplanar row, each of the discs having a perimeter shaped to maintain the space between discs substantially constant during rotation. The first stage discs are positioned to allow passage of only small fraction material and the second stage discs are positioned to allow passage of intermediate fraction material and thereby classifying the material into a small fraction, an intermediate fraction and a large fraction.

In another embodiment of the invention, a unique screen arrangement increases separating efficiency by moving materials over multiple separation stages. A receiving section agitates debris while the debris moves at an angle up to a given elevation. The agitation of the debris in combination with the angled upward movement promotes separation of the large and small sized materials. A roll over section drops the materials down to a discharge position for feeding onto a discharge section. The materials are dropped from the roll over so that the debris either falls vertically or flips over further promoting separation. The discharge section again agitates the debris while moves up a second incline until the larger debris discharges out a rear end.

The discs are interdigitized at the front end the receiving and discharge sections to prevent large materials from falling between the rows of discs. Shafts on the different sections also have separately controllable rotation speeds allows larger materials to be quickly moved out from materials dropped from the roll over section.

DETAILED DESCRIPTION OF THE INVENTION

Figure 1:
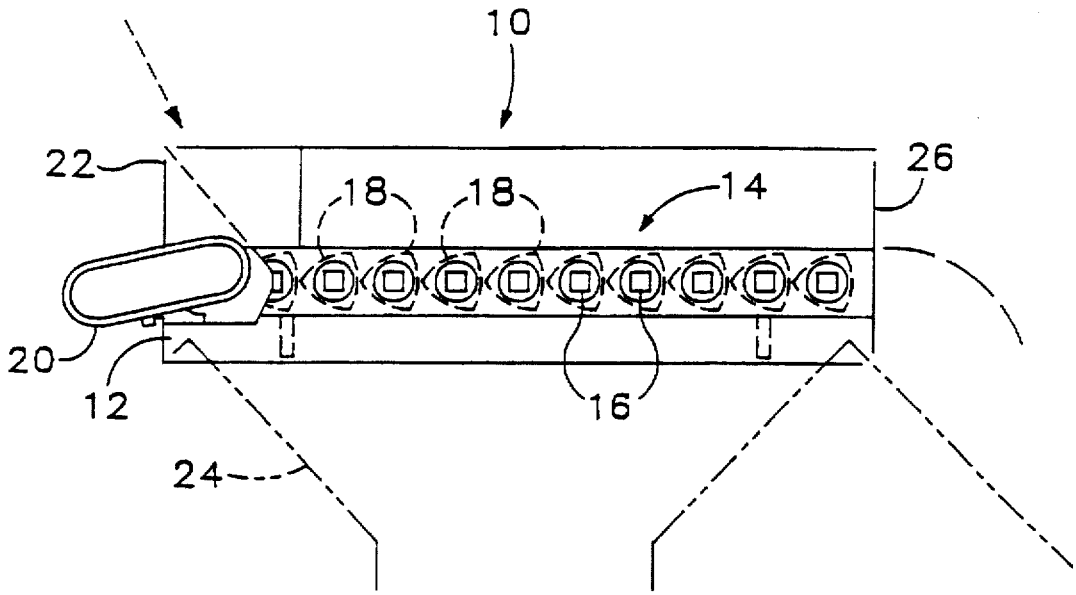
FIG. 1 is a side elevational schematic illustration of a disc screen apparatus embodying the invention.

Referring to FIG. 1, a disc screen apparatus 10 comprising a frame 12 supporting a screening bed 14 having a series of corotating spaced parallel shafts 16 of rectangular perimeter and similar length and each of which has a longitudinal series of screen discs 18. The shafts 16 are driven clockwise in unison in the same direction by suitable drive means 20. Material such as debris to be screened is delivered to the infeed end 22 of the screen bed 14 by means of a chute (not shown) as indicated by directional arrows. The constituents of acceptable size (Accepts) drop through the IFOs defined by the discs 18 and are received in a hopper 24. Debris constituents which are too large to pass through the IFOs (Overs) are advanced to and discharged, as indicated by directional arrows, from the rejects end 26 of the screening bed 14.

Figure 2:
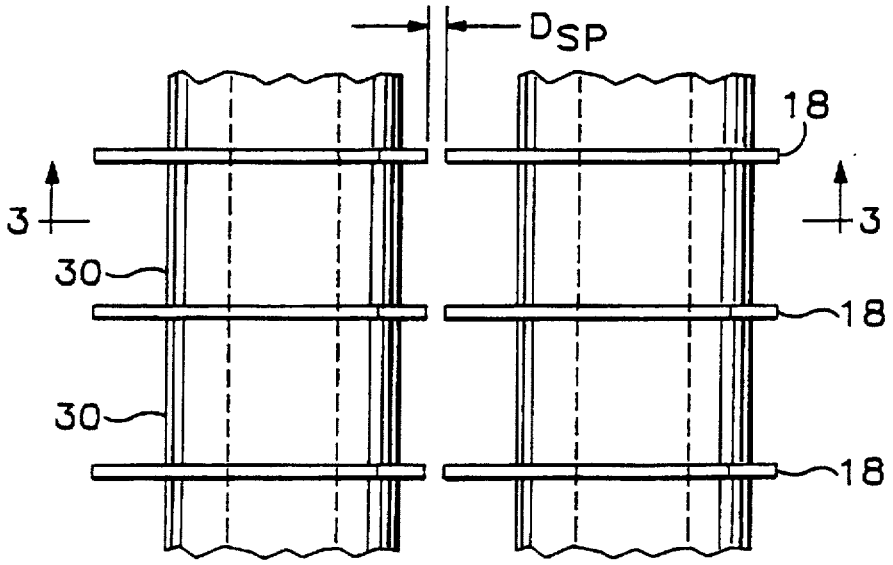
FIG. 2 is an enlarged fragmental top plan view of the screening bed of the apparatus.
Figure 3:
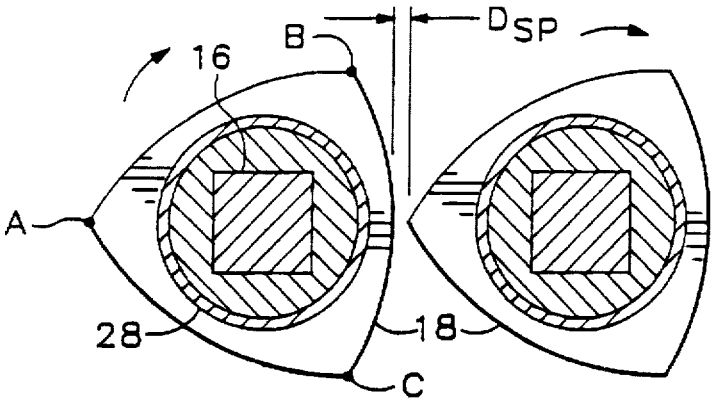
FIG. 3 is a fragmentary vertical sectional detail view taken substantially along the line 3—3 of FIG. 2.

As best seen in FIG. 2, there exists a constant space $D_{SP}$ between discs of adjacent shafts. As best seen in FIG. 3 through FIG. 3*c*, the discs 18 have perimeters shaped so that space $D_{SP}$ remains constant during rotation. Preferably the perimeter of discs 18 is defined by three sides having substantially the same degree of curvature. Most preferably, the perimeter of discs 18 is defined by drawing an equilateral triangle which has vertices A, B, and C. And thereafter drawing three arcs: (1) between vertices B and C using vertex A as the center point of the arc; (2) between vertices C and A using vertex B as the center point for the arc; and (3) between vertices A and B using vertex C as the center point of the arc.

This uniquely shaped disc perimeter provides several advantages. First, although space $D_{SP}$ changes location during the rotation of discs 18 as shown in FIGS. 3–3*c*, the distance between the discs remains constant. In conventional disc screens which have toothed discs which interdigitate, the distance between a disc and its adjacent shaft varies, depending upon the position of the disc during its rotation. This interdigitation action tends to pinch materials between the disc and its adjacent shaft, resulting in frequent jamming.

Another advantage resulting from the uniquely shaped perimeter is that as the discs 18 rotate, they move the debris in an up and down fashion which creates a sifting effect and facilitates classification. This phenomenon produces a disc screen which is very efficient in classifying materials.

Figure 4:
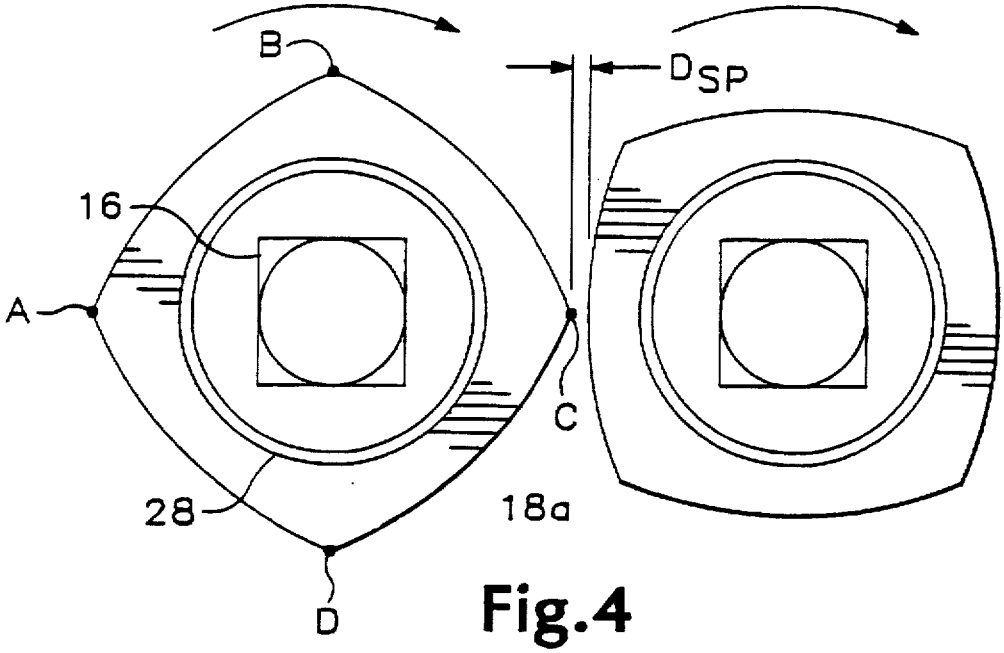
FIG. 4 is a sectional detail view of an alternative embodiment of the invention employing a four-sided disc.

Turning now to FIG. 4, an alternative embodiment of the present invention is shown. FIG. 4 illustrates a four-sided disc 18. Preferably the perimeter of the four-sided disc 18*a* is defined by having four sides having substantially the same degree of curvature. Most preferably, the perimeter of disc 18*a* is defined by (1) determining the desired center distance L between adjacent shafts and then determining the desired clearance or gap $D_{sp}$ between adjacent coplanar discs; (2) drawing a square having corners A, B, C, and D and side length S. The side length S is calculated as follows:

$$S=(L-D_{sp})*\text{COS } 45/\text{COS } 22.5.$$

Arcs are then drawn between corners A and B, B and C, C and D, and D and A. The radii R of the arcs is the difference between distance L and gap $D_{SP}$($R=L-D_{SP}$).

Figure 5:
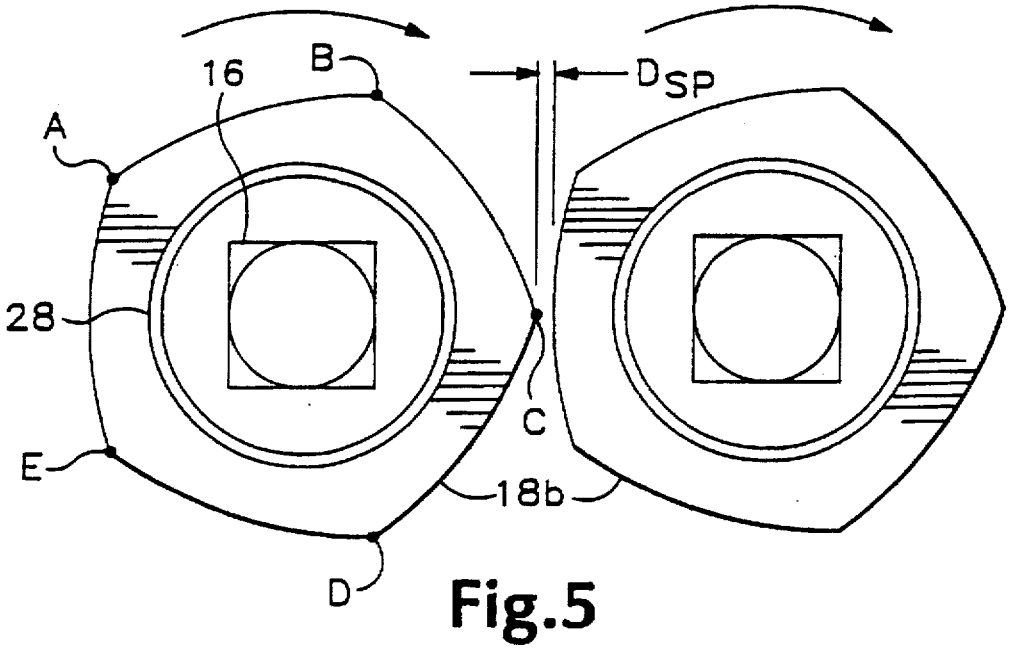
FIG. 5 is a sectional detail view of an alternative embodiment of the invention employing a five-sided disc.

Alternatively, the present invention can employ a five-sided disc 18*b* as illustrated in FIG. 5. Preferably the perimeter of the five-sided disc 18*b* is defined by having five sides having substantially the same degree of curvature. Most preferably, the perimeter of disc 18*b* is defined by drawing a regular pentagon having vertices A, B, C, D, and E. And thereafter drawing five arcs: (1) between vertices A and B using vertex D as the center point of the arc; (2) between vertices B and C using vertex E as the center point of the arc; (3) between vertices C and D using vertex A as the center point of the arc; (4) between vertices D and E using vertex B as the center point of the arc; and (5) between vertices E and A using vertex C as the center point of the arc.

Discs 18*a* and 18*b* are very beneficial in classifying materials which are more fragile or delicate. As the number of sides of the discs are increased, from 3 to 4 or 5 for example, the amplitude of rotation decreases. This effect is quite dramatic when employing larger diameter discs. Higher amplitudes of the sifting action are more likely to damage delicate or fragile materials. On the other hand, fewer sides increases the amplitude and enhances the sifting action of the screen.

For optimum results, care must be exercised to assure that the IFO spacing between the discs 18 be as accurate as practicable. To attain such accuracy, generally flat discs 18 are desirably mounted on the shafts 16 in a substantially coplanar row in substantially parallel relation and radiating outwardly from each of the shafts 16 at right angles to the longitudinal axes of the shafts 16.

Preferably, the discs 18 can be held in place by spacers 30. For this purpose, the spacers 30 comprise central apertures to receive the hubs 28 therethrough. The spacers 30 are of substantially uniform size and are placed between the discs 18 to achieve substantially uniform IFOs.

The use of spacers 30 has numerous advantages. First, the size of the IFOs can be easily adjusted by employing spacers 30 of various lengths and widths corresponding to the desired sized opening without replacing the shafts or having to manufacture new discs. The distance between adjacent discs 18 can be changed by employing spacers 30 of different lengths. Similarly, the distance between adjacent shafts can be changed by employing spacers 30 of different radial widths. Preferably, the shafts 16 can be adjusted to also vary the size of the IFOs. Thus, in this embodiment, manufacturing costs are greatly reduced as compared to mounting of the discs directly on the shaft. Moreover, damaged discs can be easily replaced.

Alternatively, the discs 18 are mounted by sets concentrically and in axially extending relation on hubs 28 complementary to and adapted for slidable concentric engagement with the perimeter of the shafts 16. For this purpose, the discs 18 comprise central apertures to receive the hubs 28 therethrough. The discs 18 are attached in substantially accurately spaced relation to one another axially along the hubs 28 in any suitable manner, as for example by welding.

Depending on the character and size of the debris to be classified, the discs 18 may range from about 6 inches major diameter to about 16 inches major diameter. Again, depending on the size, character and quantity of the debris, the number of discs per shaft range from about 5 to about 60.

Figure 6:
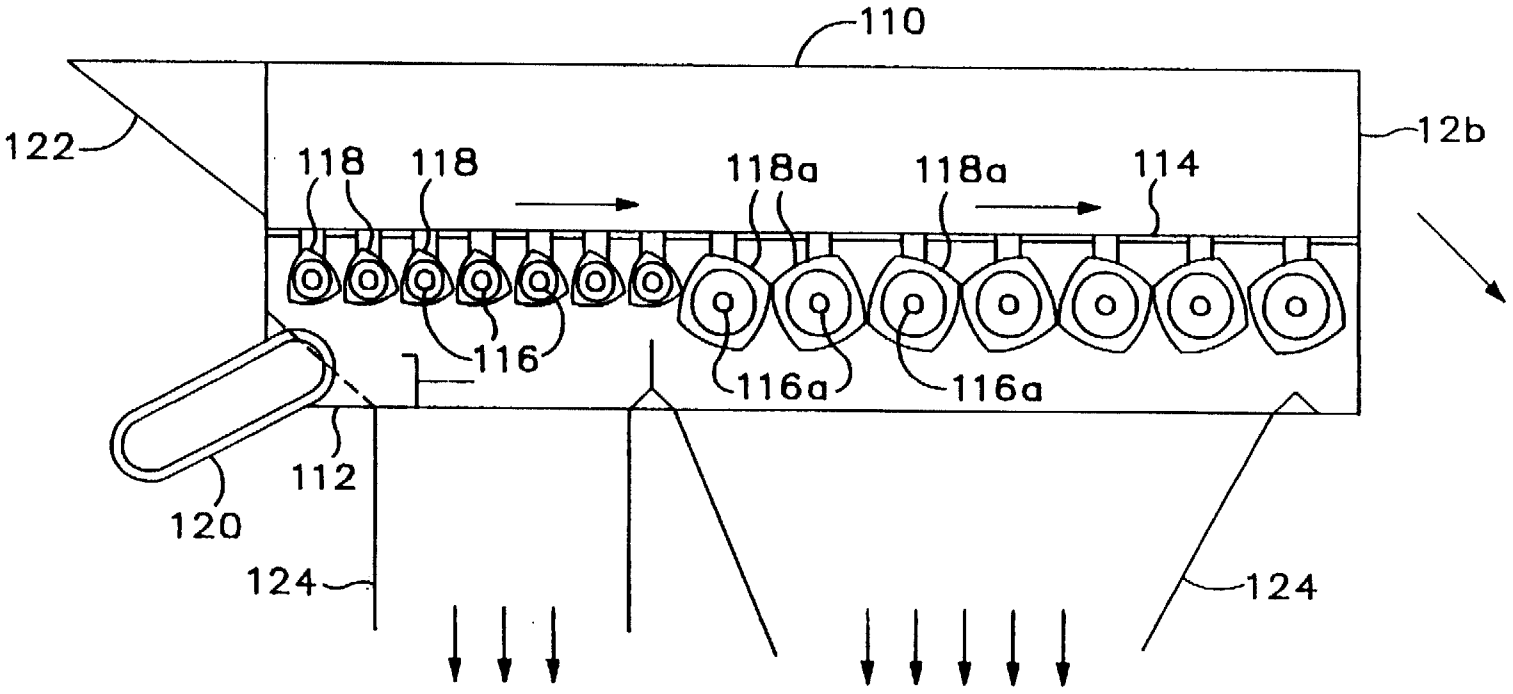
FIG. 6 is a side elevational schematic illustration of an alternative embodiment of the invention.

Referring to FIG. 6, an alternative embodiment of the invention is illustrated. A disc screen 110, comprising a frame 112 supporting a screening bed 114 having a first stage of corotating spaced parallel shafts 116 of similar length and each of which has a longitudinal series of screen discs 118 and having a second stage of corotating spaced parallel shafts 116*a* of similar length and each of which has a longitudinal series of screen discs 118*a*. The shafts 116 and 116*a* are driven clockwise as hereafter described in the same direction by suitable drive means 120. Material such as debris to be screened is delivered to the infeed end 122 of the screen bed 114 by means of a chute (not shown) as indicated by directional arrows. In the first stage of the apparatus 110, only constituents of the smallest fraction of debris drop through the IFO's defined by the discs 118 and are received in a hopper 124 as indicated by directional arrows. Debris constituents which are too large to pass through the IFOs defined by discs 118 are advanced to the second stage of the apparatus 110. In the second stage, constituents of intermediate fraction of debris drop through the IFOs defined by the discs 118*a* and are received in a hopper 124*a* as indicated by directional arrows. Debris constituents which are too large to pass through the IFOS's defined by discs 118*a* are advanced to and discharged, as indicated by directional arrows, from the rejects end 126 of the screening bed 114. Screening debris by way of this embodiment of the invention results in classifying the debris into three fractions: small, intermediate, and large.

In general the small fraction material comprises particles having a diameter of less than about 4 inches and the intermediate fraction material comprises particles having a diameter of less than about 8 inches. Preferably the small faction material particles have a diameter of less than 3 inches and the intermediate fraction material particles have a diameter of less than 6 inches. Most preferably, the small fraction particles have diameters of less than 2 inches and the intermediate fraction particles have diameters of less than 4 inches.

In general, debris traveling horizontally through the first stage travels at a velocity ranging from about 50 to 200 feet per minute (FPM) and the debris traveling horizontally through the second stage at a velocity from about 50 to 250 FPM. Preferably the first stage debris travels at a velocity of about 75 to 150 FPM, most preferably from about 120 FPM; and the second stage debris travels at a velocity ranging from about 100 to 200 FPM, most preferably from about 146 FPM.

Although many combinations of first stage and second stage velocities may be chosen, it is desirable that the first stage and second stage discs rotate in cooperation with one another. To maintain a constant gap between the last row of the first stage discs and the first row of second stage discs, the discs must rotate so that the peak or points of the first stage disc correspond to the sides or valleys of the second stage discs. This relationship is maintained by the following formula:

$$(RPM)_1=(S_2/S_1)(RPM)_2$$

where $(RPM)_1$ and $(RPM)_2$ are the revolutions per minute of the first stage discs and second stage discs, respectively, and $S_1$ and $S_2$ are the number of sides of the first stage discs and the second stage discs respectively. For example, for a two stage screen using 3 and 4 sided discs, $(RPM)_1=4/3(RPM)_2$. That is, the four-sided second stage discs are rotated at ¾ the rotation speed of the three-sided first stage disc to maintain proper spacing.

As with other previously discussed embodiments of the invention, discs 118 and 118*a* have perimeters shaped so that space $D_{SP}$ remains constant during rotation. Preferably the perimeter of discs 118 is defined by three sides having substantially the same degree of curvature and defined as shown in FIGS. 2–3*c*. Similarly, the perimeter of discs 118*a* is defined by four sides having substantially the same degree of curvature and defined as shown in FIG. 4.

Multi-stage disc screens have several advantages. First, additional stages allows the user to classify material into multiple factions of increasing size. In addition, multiple stage classifying using a screen results in more efficient separation. Because the velocity of the second stage is greater than the first stage discs, the material which is speeds up and tends to spread out when it passes from the first stage to the second stage of the bed. This in turn accelerates the separation process and results in more efficient screening.

In alternative embodiments of the invention, additional stages may be added to the apparatus to provide further classifying of the debris to be screened. For example, a three stage screen could be employed where the first stage comprises three sided discs, the second stage comprises four-sided discs, and third stage comprises five-sided discs. Here $(RPM)_2=3/4(RPM)_1$, and $(RPM)_3=3/5(RPM)_1$. Classifying debris with this embodiment of the invention would produce four fractions of debris having graduated sized diameters.

Figure 7:
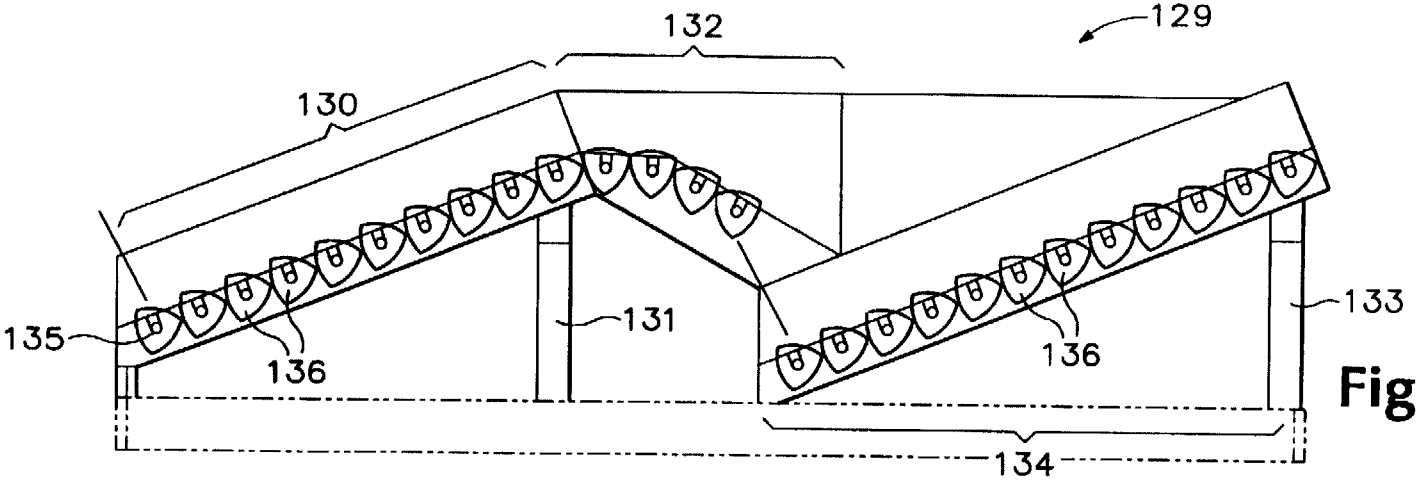
FIG. 7 is a side sectional view of a multistage screen for separating office sized waste paper according to another alternative embodiment of the invention.
Figure 8:
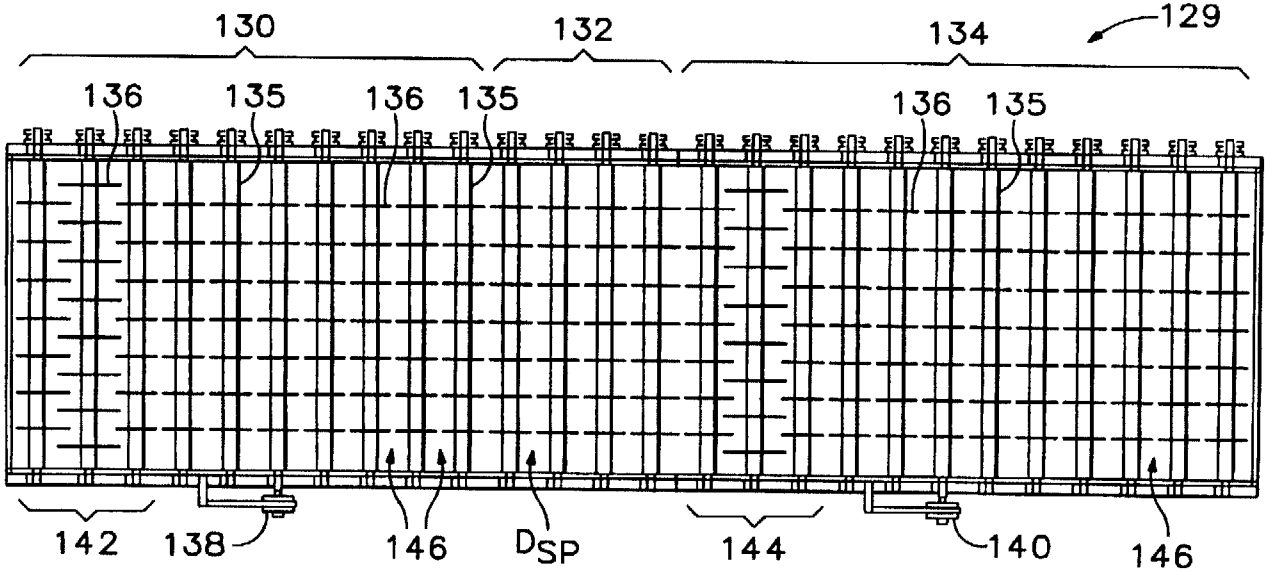
FIG. 8 is a top plan view of the multistage screen shown in FIG. 8.

Referring to FIGS. 7 and 8, a multistage screen 129 includes discs 136 similar to discs 18 previously shown in FIG. 1. The screen 129 comprises a receiving section 130 that inclines upward at an angle of approximately 20 degrees. Receiving section 130 is supported by a pillar 131. A roll over section 132 is attached to the rear end of receiving section 130 and provides a slight downwardly sloping radius that extends over the front end of a discharge section 134. The discharge section 134 also inclines at an angle of approximately 20 degrees and is supported by a pillar 133. Sections 130, 132, and 134 each include a series of corotating parallel shafts 135 that contain a longitudinal series of screen discs 136. The shafts 135 contained in sections 130 and 132 are driven in unison in the same clockwise direction by drive means 138. The shafts 135 in section 134 are driven by a separately controllable drive means 140.

Referring specifically to FIG. 8, the discs 136 on the first three rows 142 of shafts 135 in receiving section 130 overlap in an interdigitized manner. Specifically, discs 136 on adjacent shafts extends between longitudinally adjacent discs on common shafts. The discs on the first three rows 144 of shafts 135 in discharge section 134 overlap in the same manner as the discs on rows 142. The discs on subsequent rows after rows 142 and 144 are aligned in the same longitudinal positions on each shaft 135. Discs 136 on adjacent shafts 135 in the same longitudinal positions have outside perimeters that are spaced apart a distance $D_{sp}$ of between ⅜ to ½ inches. The small distance between the discs on adjacent shafts form secondary slots 146.

Figure 3A:
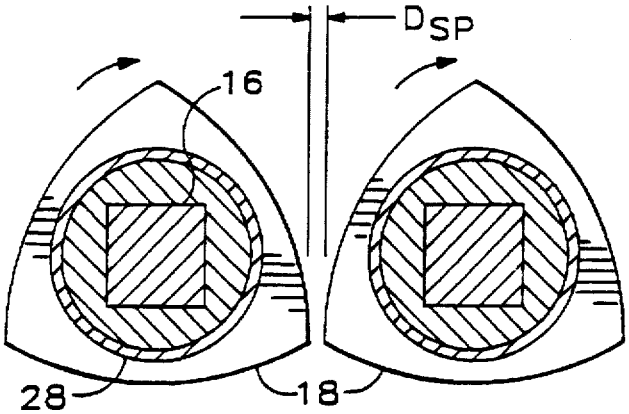
FIG. 3*a* is a sectional detail view, as depicted in FIG. 3, where the adjacent discs are rotated 90 degrees about their respective horizontal axes.
Figure 3B:
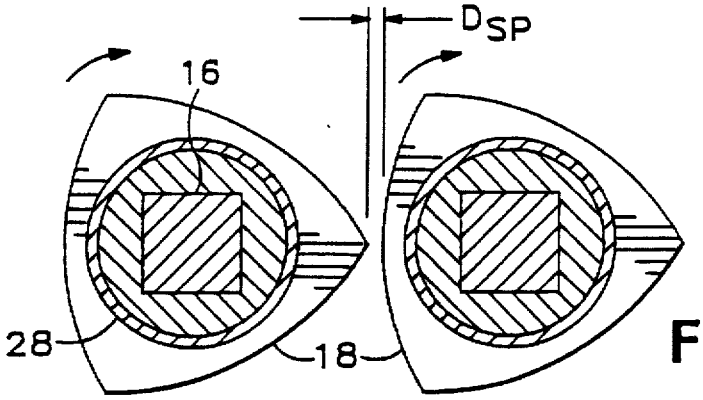
FIG. 3*b* is a sectional detail view, as depicted in FIG. 3, where the adjacent discs are rotated 180 degrees about their respective horizontal axes.
Figure 3C:
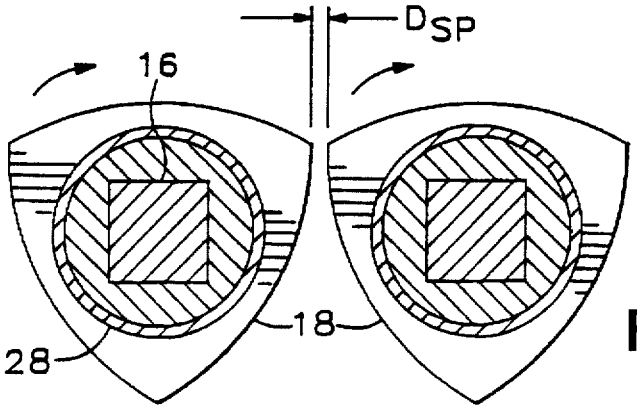
FIG. 3*c* is a sectional detail view, as depicted in FIG. 3, where the adjacent discs are rotated 270 degrees about their respective horizontal axes.

The discs 136 are all aligned and rotated in phase to maintain the same relative angular positions during rotation as previously shown in FIGS. 3A–3C. Thus, the distance $D_{SP}$ between discs remains constant as the shafts 135 rotate the discs 136 in a clockwise direction. The constant distance of the secondary slots 146 allow precise control over the size of debris that falls down through screen 129. Also as described above, the unique tri-arch shaped perimeter of the discs 136 move debris along the screen 129 while at the same time moving the debris up and down. The up and down motion of the debris as the debris moves up the screen at an angle creates a sifting effect that facilitates classification as described below.

Figure 9:
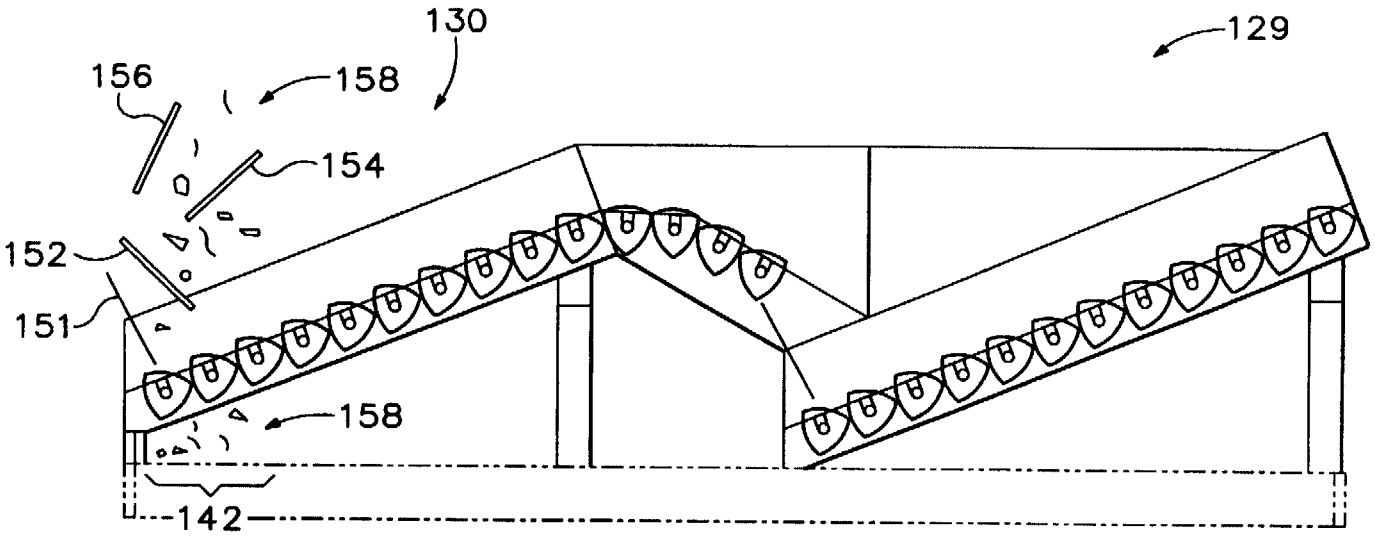
FIGS. 9–13 are a series of side views showing material traversing through different separation stages of the system shown in FIG. 7.

Referring to FIGS. 9–13, the multistage screen operates in the following manner. As shown in FIG. 9, common office size waste paper (OWP) includes pieces of old corrugated cardboard (OCC) 152–156 and pieces of 8½ inch×11 inch paper 158. The OWP is carried by a conveyer (not shown) and dumped through a chute (not shown) onto receiving section 130. Much of the paper 158 falls between the discs 136 and onto a conveyer or large bin (not shown) below screen 129. The overlapping discs on rows 142 (FIG. 8) prevent the OCC 152–156 from falling through receiving section 130.

Figure 10:
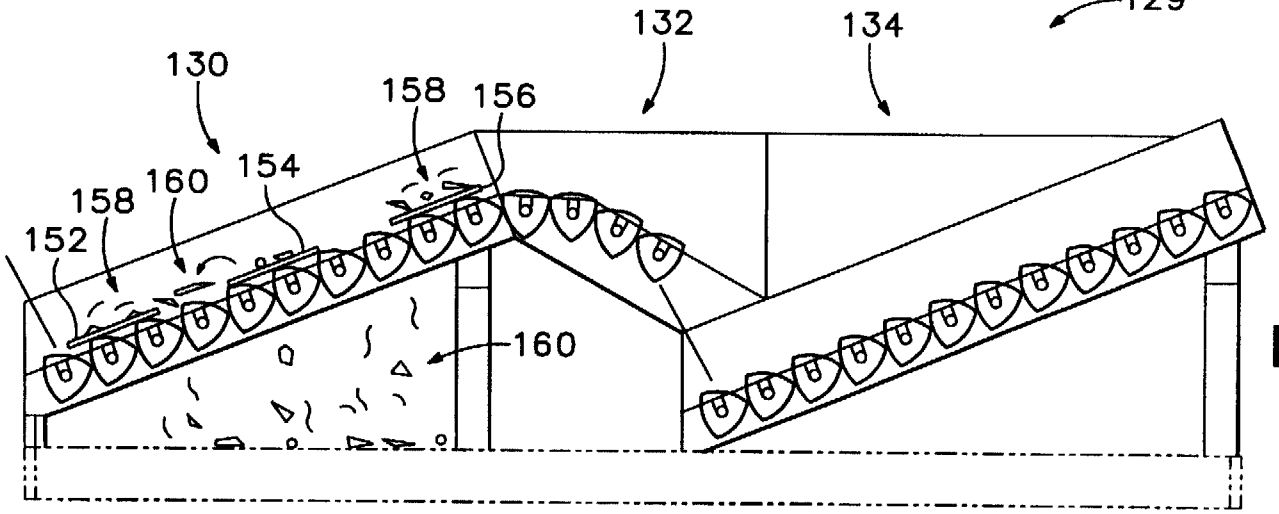

Referring to FIG. 10, the OCC 152–156 after being dropped onto screen 129 lies flat on top of the discs 136. Because the OCC 152–156 now lies in a parallel alignment with the upwardly angled direction of receiving section 130, the OCC is not in danger of falling between adjacent rows of discs. Thus, the discs 136 on adjacent shafts can be aligned in the same lateral positions forming the secondary slots 146 shown in FIG. 8.

As the OCC 152–156 falls flat on the screen 129, some paper 158 falls on top of the OCC preventing the paper 158 from falling through receiving section 130. The tri-shaped outside perimeter of the discs 136 in combination with the inclined angle of receiving section 130 agitates the OCC 152–156 forcing some of the paper 160 to slide off the rear end of the OCC and through the screen 129. The secondary slots 146 (FIG. 8) provide further outlet for the paper 160 to fall through screen 129.

Figure 11:
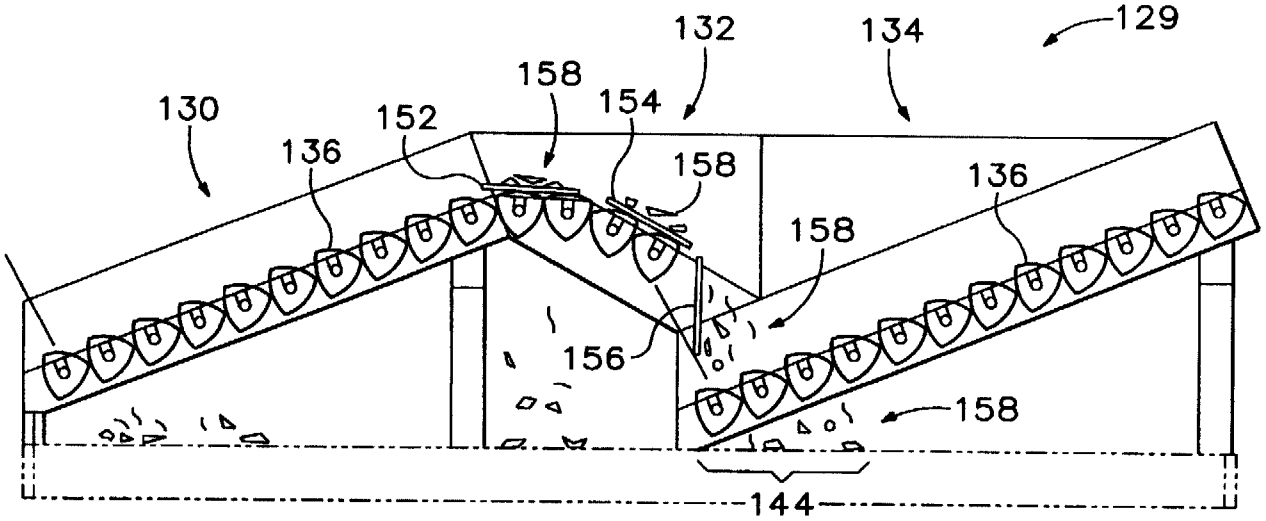

Referring to FIG. 11, to further promote separation, the OCC 152–156 is dropped or "flipped over" onto discharge section 134. Paper 158 which would normally not be separated during the discs agitation process performed by receiving section 130 is more likely to be dislodged by dropping the OCC vertically downward or flipping the OCC over. However, simply sending the OCC 152–156 over the top of receiving section 130 would launch the OCC in a horizontal direction onto discharge section 134. This horizontal launching direction is less likely to dislodge paper 158 still residing on the OCC. Launching also increases the possibility that the OCC will not land on discharge section 134.

Roll over section 132 contains four rows of discs that orient the OCC 152–156 in a sight downwardly sloping direction (OCC 154). When the OCC is dropped from screen section 132 in this downwardly sloping orientation, the OCC will either drop down onto section 134 in a vertical direction or will flip over, top side down, as shown by OCC 156. Thus, paper 158 on top of OCC 156 is more likely to become dislodged and fall through discharge section 134. As described above in FIG. 8, the first three rows 144 in discharge section 134 have overlapping discs that prevent OCC from passing through the discs 136. Referring back to FIG. 8, the shafts in receiving section 130 and roll over section 132 are rotated by drive means 138 and the shafts 135 in discharge section 134 are separately rotated by dive means 140. The shafts in discharge section 134 are rotated at a faster speed than the shafts in sections 130 and 132. Thus, OCC 152–156 dropped onto discharge section 134 will not keep paper 158 from falling through screen 129.

Figure 12:
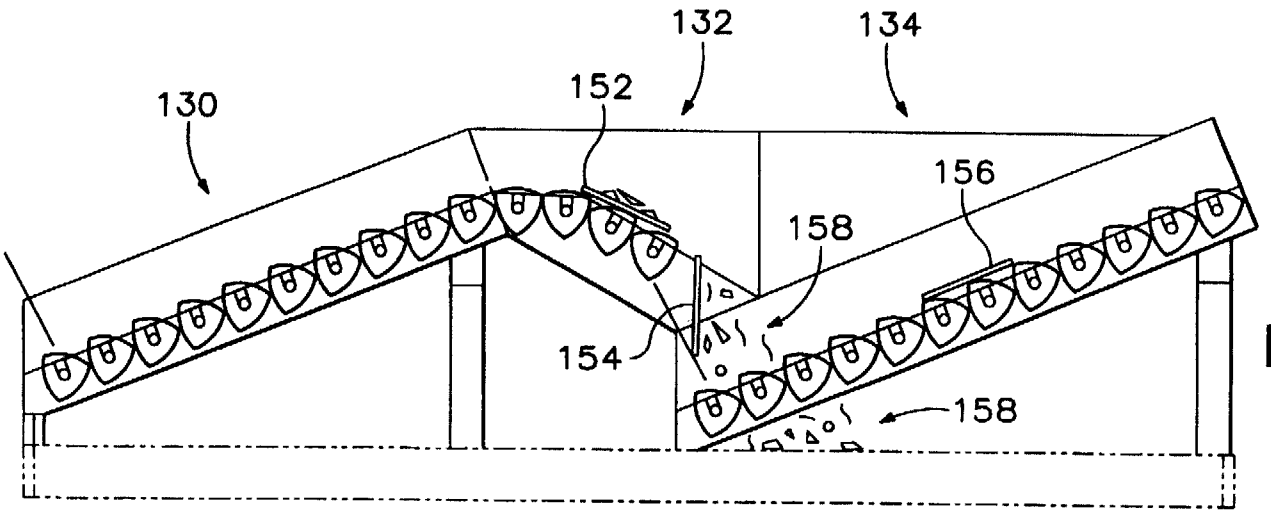
Figure 13:
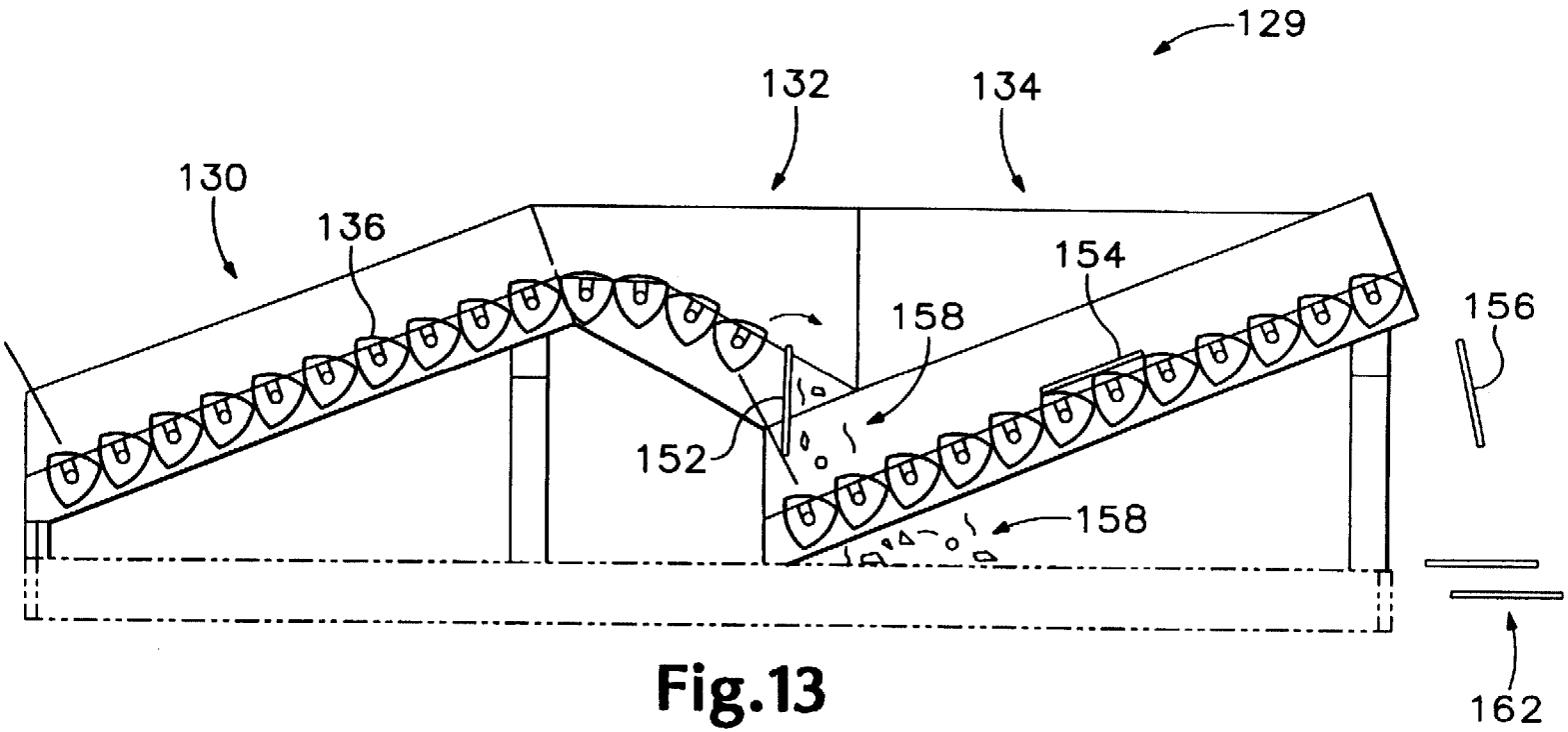

To explain further, FIG. 12 shows the OCC 156 being moved quickly up discharge section 134 out from under the rear end of roll over section 132. Thus, OCC 156 is sufficiently distanced out from under roll over section 132 before OCC 154 is dropped onto discharge section 134. As a result, paper 158 falling from OCC 154 will not land on OCC 156 allowing free passage through discharge section 134. FIG. 13 shows the separated OCC 156 being dropped onto a pile 162 of OCC at the end of discharge section 134.

The multistage screen 129 provides four separation stages as follows:

1) Dropping OWP onto receiving section 130;
2) Agitating the OWP while moving at an angle up receiving section 130;
3) Angling and then dropping the OWP from roll over section 132 so that the OCC falls in a vertical angle or flips over onto discharge section 134; and
4) Agitating the OWP while moving at an angle up discharge section 134.

As a result of the multiple separation stages, the screen 129 is effective in separating OWP.

It will be understood that variations and modifications may be effected without departing from the spirit and scope of the novel concepts of this invention.

We claim:

1. A screen for classifying material by size comprising:

a receiving section having a front end and a rear end, the receiving section inclining upward from the front end to the rear end at a given angle;

a plurality of shafts mounted on the receiving section substantially parallel with one another, the shafts extending up from the front end to the rear end of the receiving section in a substantially coplanar alignment at the given angle;

discs mounted on the shafts, each of the discs having an arched perimeter shape that maintains a space between discs substantially constant during rotation while moving material on said discs up and down;

a discharge section having a front end and a rear end, the front end of the discharge section located underneath the rear end of the receiving section; and a roll over section joined to the rear end of the receiving section and arching downward from the rear end of the receiving section, the roll over section suspended above the discharge section thereby dropping material while moving in a downward direction in a downwardly angled and forward direction onto the discharge section.

2. A screen according to claim 1 wherein the roll over section includes a substantially horizontal portion joined to the rear end of the receiving section and a downwardly directed portion extending from the horizontal portion.

3. A screen according to claim 1 wherein the discharge section inclines upward from the front end to the rear end at a given angle, the discharge section including discs at the front end interdigitized between discs extending from adjacent shafts and discs behind the front end of the discharge section aligned longitudinally between each shaft.

4. A screen according to claim 3 including a plurality of shafts mounted on the receiving section in a substantially parallel alignment with one another from the front end to the rear end of the receiving section; and discs mounted on the shafts in substantially parallel rows, each of the discs having a shape that maintains a parameter distance between discs substantially constant during rotation while moving material on said discs up and down.

5. A screen according to claim 4 wherein the perimeter of the discs on the receiving and discharge sections are defined by three arcs having substantially the same degree of curvature.

6. A screen according to claim 1 including first and second separately controllable drive means, the first drive means rotating the shafts on the receiving section at a first rotational speed and the second drive means rotating the shafts on the discharge section at a second rotational speed faster than the first rotational speed.

7. A screen for classifying material by size comprising:

a receiving section having a front end and a rear end, the receiving section inclining upward from the front end to the rear end at a given angle;

a plurality of shafts mounted on the receiving section substantially parallel with one another, the shafts extending up from the front end to the rear end of the receiving section in a substantially coplanar alignment at the given angle; and discs mounted on the shafts, each of the discs having an arched perimeter shape that maintains a space between discs substantially constant during rotation while moving material on said discs up and down, the discs at the front end of the receiving section interdigitized between discs extending from adjacent shafts and discs behind the front end of the receiving section aligned in the same longitudinal positions on each shaft.

8. A method for classifying material by size comprising the steps of:

defining a receiving stage of a conveyer including a plurality of shafts arranged to define a substantially array extending at a given inclined angle;

mounting noncircular discs on the shafts in substantially parallel rows;

rotating the shafts in the same direction;

dropping material on the shafts at a first end of the receiving stage so that shaft rotation causes the material to be pushed by the discs up the receiving stage;

shaping a parameter of the discs so that the discs agitate the material in an up and down motion while pushing the material up the receiving stage in a forward direction;

carrying the material on the conveyor from the given inclined angle of the receiving stage to a downwardly sloping angle; and dropping the material from the receiving stage while moving in the downwardly sloping angle and forward direction thereby causing the material to drop or flipover in a vertically downward and forward direction.

9. A method according to claim 8 including selectively moving the shafts and the discs to define a plurality of uniform secondary slots between the discs;

rotating the shafts in the same direction;

dropping the material on the shafts so that shaft rotation causes the material to be pushed by the discs across the shafts in the array; and maintaining spacing of the secondary slots between discs in adjacent rows during shaft rotation.

10. A method according to claim 9 including the following steps:

defining a discharge stage of a conveyer including a plurality of shafts arranged to define an array extending at a given inclined angle;

mounting noncircular discs on the shafts of the discharge stage substantially parallel rows; and dropping the downwardly sloping materials from the receiving stage onto the discharge stage.

11. A method according to claim 10 including rotating the shafts in the receiving stage at a first rotational speed and rotating the shafts in the discharge stage at a second rotational speed faster than the first rotational speed.

12. A method according to claim 11 including moving the material at an incline up the discharge stage while at the same time vibrating the material up and down.

13. A screen for classifying material by size comprising:

a receiving section having a front end and a rear end;

a discharge section including a front end located below the rear end of the receiving section, and a rear end, a plurality of shafts mounted on the discharge section substantially parallel with one another, the shafts extending from the front end to the rear end of the discharge section in a substantially coplanar alignment; and discs mounted on the shafts, each of the discs having an arched perimeter shape, the discs at the front end of the discharge section interdigitized between discs extending from adjacent shafts and discs behind the front end of the discharge section aligned in the same longitudinal positions on each shaft.

14. A screen according to claim 13 including the following:

a plurality of shafts mounted on the receiving section substantially parallel with one another, the shafts in the receiving section extending from the front end to the rear end of the receiving section in a substantially coplanar alignment; and discs mounted on the shafts of the receiving section, each of the discs having an arched perimeter shape, the discs at the front end of the receiving section interdigitized between discs extending from adjacent shafts and discs behind the front end of the receiving section aligned in the same longitudinal positions on each shaft.

15. A screen according to claim 14 including a roll over section joined to the rear end of the receiving section and arching downward from the rear end of the receiving section, the roll over section suspended above the discharge section thereby dropping the material while in a downward direction in a downwardly angled and forward direction onto the discharge section.

* * * * *